US008336973B2

(12) United States Patent
Berger

(10) Patent No.: US 8,336,973 B2
(45) Date of Patent: Dec. 25, 2012

(54) FLUSH-MOUNTED GUIDING ARRANGEMENT FOR FURNITURE COMPONENTS, IN PARTICULAR DRAWERS IN THE BODY OF FURNITURE PIECES

(75) Inventor: Horst Berger, Bielefeld (DE)

(73) Assignee: Alfit AG, Götzis (AT)

( * ) Notice: Subject to any disclaimer, the term of this patent is extended or adjusted under 35 U.S.C. 154(b) by 778 days.

(21) Appl. No.: 12/297,019

(22) PCT Filed: Apr. 10, 2007

(86) PCT No.: PCT/EP2007/003155

§ 371 (c)(1),
(2), (4) Date: Mar. 16, 2009

(87) PCT Pub. No.: WO2007/118632

PCT Pub. Date: Oct. 25, 2007

(65) Prior Publication Data

US 2009/0251037 A1 Oct. 8, 2009

(30) Foreign Application Priority Data

Apr. 13, 2006 (DE) ..... 20 2006 006 065 U

(51) Int. Cl.
*A47B 88/00* (2006.01)

(52) U.S. Cl. ..... 312/334.4; 312/334.6

(58) Field of Classification Search ..... 312/334.8, 312/334.14, 350, 330.1, 334.1, 334.4–334.6; 384/22

See application file for complete search history.

(56) References Cited

U.S. PATENT DOCUMENTS

| | | | | |
|---|---|---|---|---|
| 5,439,283 | A * | 8/1995 | Schroder et al. | 312/334.4 |
| 5,580,139 | A * | 12/1996 | Grabher | 312/333 |
| 5,588,729 | A * | 12/1996 | Berger | 312/334.4 |
| 6,854,817 | B1 * | 2/2005 | Simon | 312/334.6 |
| 6,945,618 | B2 * | 9/2005 | Kim et al. | 312/334.4 |
| 2001/0019235 | A1 | 9/2001 | Hammerle | |

(Continued)

FOREIGN PATENT DOCUMENTS

DE 9318383 U1 2/1994

(Continued)

OTHER PUBLICATIONS

International Search Report from the European Patent Office, mailed Oct. 10, 2007.

*Primary Examiner* — James O Hansen
*Assistant Examiner* — Andres F Gallego
(74) *Attorney, Agent, or Firm* — Norris McLaughlin & Marcus, P.A.

(57) ABSTRACT

A flush-mounted guiding arrangement adjustably mounts furniture parts that are extractably and insertably mounted inside a furniture carcass by means of a pair of extensible guides encompassing one respective guide rail. The sliding rail is longitudinally guided on the guide rail and can be placed in the lateral edge region on the bottom face of the extractable furniture part. An adjusting fixture grips the bottom of the furniture part that is to be mounted and in the forward end area of the sliding rail. The adjusting fixture has a mechanism for adjusting the position of a sliding rail relative to the extractable furniture part in the direction of at least one axis of a Cartesian coordinate system formed by three coordinate axes that run substantially perpendicular to each other.

20 Claims, 8 Drawing Sheets

U.S. PATENT DOCUMENTS

| | | | | |
|---|---|---|---|---|
| 2002/0158557 | A1* | 10/2002 | Weichelt | 312/334.4 |
| 2004/0095047 | A1* | 5/2004 | Salice | 312/332.1 |
| 2004/0227440 | A1 | 11/2004 | Booker et al. | |
| 2008/0218045 | A1* | 9/2008 | Moser | 312/333 |

FOREIGN PATENT DOCUMENTS

| | | | |
|---|---|---|---|
| DE | 9320197 | U1 | 5/1994 |
| DE | 29600180 | U1 | 2/1996 |
| DE | 202004015100 | U1 | 2/2006 |
| EP | 761132 | A1 * | 3/1997 |
| EP | 1374730 | A1 | 1/2004 |
| EP | 1621107 | A | 2/2006 |

* cited by examiner 10
12
14
16
18
20
22
24
26
28
36
40
90
2
5

204
206
134
128
136
142
148
II
144b
144
132
170
168
202
200

134
128
142
148
140
132
136
152

124
120
128
130
122
170
144b
A 124
134
170
132
130
122
144b

FLUSH-MOUNTED GUIDING ARRANGEMENT FOR FURNITURE COMPONENTS, IN PARTICULAR DRAWERS IN THE BODY OF FURNITURE PIECES

The invention relates to a flush-mounted guiding arrangement for adjustable support of furniture components, in particular drawers etc., which are supported for extension and retraction in the body of a piece of furniture by a pair of telescopic guides, each having a guide rail attachable to a support wall of the furniture body and a sliding rail which is guided for longitudinal displacement on the guide rail by roller bearings—optionally with an intermediate center rail—and which is positionable on the bottom side of the pullout furniture component, which encompasses the guide rail at least partially from above and is shaped as a rail profile that is open on the bottom side.

Retractable and extendable support for drawers—but also for other furniture component that are retractably and extendably supported in the body of cabinets, such as work platforms, device holders, etc.—is presently accomplished with, at least in high-end furniture pieces, with telescopic guides mounted on the lateral support walls that receive the drawer in the cabinet body. The telescopic guides have a guide rail implemented as a metal rail profile that can be attached to the corresponding support wall and a sliding rail likewise implemented as metallic rail profile that is guided by rollers for movement relative to the guide rail. In so-called "fully extendable" drawers, a center rail can be interposed between the guide rail and the sliding rail. The lateral edge region of the pullout furniture components, i.e., typically the drawers, is secured on the top side of the sliding rail, i.e., in the so-called flush mounted arrangement underneath the bottom. Even if the components of the cabinet body and the drawer are manufactured with great precision and the telescopic guides are installed in the cabinet body true to gauge, it cannot be avoided that the drawers in the cabinet body or adjacent drawers of a drawer cabinet are not precisely aligned relative to one another during installation or subsequently changes—e.g., as a result of dimensional changes of the wooden components of the furniture piece itself caused by drying out or moisture absorption from the atmosphere. Such misalignment of the drawers relative to one another produces objectionable differences in gap sizes or changes the gap size across the width of the drawer, in particular in drawer cabinets with a large number of adjacent drawers. The front panels of the drawers can also have a noticeable difference in slope if the guide rails in the furniture body are not mounted exactly horizontally, which the user may also find objectionable. Accordingly, there is a need for making the support of drawers and other pullout furniture components in the corresponding body adjustable so as to be able to correct misalignment during installation or during later inspection.

It is an object of the invention to enable correction of misalignments of pullout furniture components in the body of furniture pieces, which can be made quickly, easily and inexpensively, even at a later time.

Based on the guiding arrangement of the aforedescribed type, the object is attained with the invention in that an adjustment fitting is provided at least in the front end region of the sliding rail, as viewed in the pullout direction, which operates on the bottom side of the supported furniture component and has an adjustment mechanism for adjusting the position of the sliding rail relative to the pullout furniture component in the direction of at least one axis of a Cartesian coordinate system formed of three mutually substantially perpendicular coordinate axes.

Misalignment of the pullout furniture component can be advantageously corrected in that the adjustment fitting includes a support element adapted to contact the bottom side of the pullout furniture component and disposed on the sliding rail for height adjustment in the vertical direction.

Advantageously, the support element may include a support plate supported in an opening of the web surface of the sliding rail and configured for contacting the bottom side of the pullout furniture component, and the adjustment mechanism may include means for changing the position of the top side of the support plate relative to the top side of the web surface of the sliding rail in the direction defining the height.

According to a particularly advantageous embodiment, a leg section of at least one of the lateral edges of the support plate that extends in the pullout direction may be bent essentially at a right angle, with the edge(s) overlapping with the lateral legs of the sliding rail, wherein the leg section(s) is/are supported relative to the lateral legs of the sliding rail for pivoting about a horizontal axis oriented perpendicular to the pullout direction.

The height adjustment mechanism may include a lever arm which is rotatably supported with one of its ends on the associated adjacent lateral leg of the sliding rail, wherein the lever arm is non-rotatably connected with an eccentric element arranged in a slotted opening in the associated lateral leg that is angled relative to the support plate. The free end of the lever arm is used as a handle for height adjustment, i.e., no special tool is required.

According to another advantageous embodiment of the invention, the adjustment fitting may include a bracket-shaped adjustment console which overlaps with the sliding rail perpendicular to the pullout direction with lateral play. The end of the adjustment console facing the support wall of the furniture body can be brought into entraining engagement with the pullout furniture component horizontally and transversely to the pullout direction of the sliding rail. Means engaging the sliding rail for lateral horizontal displacement of the sliding rail relative to the adjustment console within the limitations of the lateral play are provided on the opposing end of the bracket-shaped adjustment console facing away from the support wall.

The entrainment engagement of the adjustment console with the pullout furniture component can be implemented, for example, with a vertical dowel pin having an upward-pointing free end and disposed on the end of the bracket-shaped adjustment console facing the support wall, wherein the dowel pin can be inserted in an opening of a receiving bore which is open towards the bottom and arranged on the bottom side of the pullout furniture component.

To eliminate play during adjustment, the dowel pin may have a diameter which substantially corresponds to the diameter of the receiving bore, wherein the free end of the dowel pin is formed as a tapered truncated cone to facilitate insertion into the receiving bore.

Advantageously, the dowel pin may be arranged on the end of the bracket-shaped adjustment console facing the support wall for springy downward displacement in the vertical direction.

In an advantageous embodiment, the means for lateral horizontal displacement of the sliding rail relative to the pullout furniture component may include a threaded rod engaging with a lateral leg of the sliding rail facing away from the support wall. An adjusting nut can be screwed on the threaded rod, wherein the adjusting nut is rotatably supported relative to the bracket-shaped adjustment console, but is supported on the threaded rod so that its position is fixed relative to the bracket-shaped adjustment console in the lateral adjustment direction.

Advantageously, the threaded rod may operate on the lateral legs of the sliding rail with a rotation lock, wherein an entraining element connected with the end of the bracket-shaped adjustment console facing away from the support wall overlaps with opposing end faces of the adjusting nut. The entraining element may be formed by locking tabs which are rigidly mounted on the corresponding end of the bracket-shaped adjustment console and terminate on their free end facing the threaded rod an open slot which encompasses the threaded rod.

To prevent the pullout furniture component from disengaging from its entrainment engagement with the receiving bore, for example during a height adjustment, it is proposed according to another embodiment of the invention that the adjustment fitting includes an elongated safety bolt supported for horizontal and transverse movement relative to the pullout direction, with the free end of the safety bolt facing the support wall being pre-biased into a displacement position which protrudes over the support-wall-side leg of the sliding rail. The free end engages with a corresponding receiving opening in the pullout furniture component, and means are provided on the opposing end of the safety bolt facing away from the support wall for retracting the safety bolt against the spring bias into a retracted position away from the receiving opening.

Advantageously, a handle may be provided on the end of the safety bolt facing away from the support wall, wherein actuation of the handle causes the safety bolt to be displaced against the spring bias to the retracted position away from the receiving opening.

For example, the handle may be configured as a lever which is non-rotatably disposed on the end of the safety bolt facing away from the support wall. The pivoting motion of the lever generates, by way of three-dimensional curve tracking, a displacement component of the safety bolt into the retracted position away from the receiving opening.

Advantageously, a locking device may be provided which locks the handle in a position where the safety bolt is retracted from the receiving opening.

Another option for adjusting the pullout furniture component in the horizontal displacement direction of the sliding rail can be implemented in that the adjustment fitting includes a component formed as an eccentric cam, which is arranged on the outside of the leg of the sliding rail facing away from the support wall and which can rotate about a horizontal axis extending perpendicular to the pullout direction. The component may be arranged in the adjustment fitting in a slotted vertical opening oriented perpendicular to the pullout direction and having a width that substantially corresponds to the outer diameter of the eccentric cam. Means for rotating the eccentric component may also be provided.

Advantageously, the means for rotating the eccentric component may be disposed in the slotted opening on the exposed end face of the eccentric component that faces away from the support wall, for example, in the form of recesses or projections configured for engagement with a rotation tool and disposed on the end face of the eccentric cam.

When the pullout furniture component is secured in the aforedescribed manner by a pre-biased safety bolt engaging in a receiving opening so that it cannot be pulled away from the dowel pin, the receiving opening provided for receiving the safety bolt in the pullout furniture component should advantageously have a length measured in the pullout direction that is greater by at least twice the eccentricity of the eccentric cam than the diameter of the end of the safety bolt that engages with the receiving opening.

According to a second exemplary embodiment of the invention, the adjustment fitting may include a base component which can be attached to make contact with the bottom side of the pullout furniture component and which has a locking member springily engaging with a locking receptacle disposed on the sliding rail when the sliding rail of the telescopic guide on the pullout furniture component is in the predetermined mounting position. The adjustment mechanism may include an adjustment member with a threaded rod having a longitudinal center axis oriented parallel to the bottom side of the pullout furniture component and substantially perpendicular to the pullout direction of the sliding rail. On one hand, the threaded rod of the adjustment member threadingly engages with a complementary thread provided on the sliding rail or the base component and is, on the other hand, rotatably supported in the longitudinal direction of the rod, while being fixed on the base component and/or the sliding rail.

Preferably, the threaded rod of the adjustment member engages in the complementary threaded bore disposed in the sliding rail, wherein the free end of the threaded rod protruding from the threaded bore is coupled to the base component for rotation, and is displaceable in the longitudinal direction of the threaded rod.

The threaded rod is preferably coupled to the base component by a circumferential groove disposed in the region of the free end of the threaded rod of the adjustment member, with a projection disposed on the base component engaging in the grooves.

Advantageously, the projection may be formed by a locking plate disposed on the base component and having a slotted opening which is open on the bottom side. The unobstructed width of the opening is approximately equal to the diameter measured above the groove bottom of the groove disposed in the threaded rod, while the thickness of the opening is approximately equal to the unobstructed width of the groove at least in the region inside the groove corresponding to the defined entrainment position.

To facilitate lateral adjustment of the pullout furniture component, a handle for rotating the threaded rod may advantageously be provided in the region of the threaded rod that protrudes from the threaded bore.

The handle may be formed by a circumferential ring flange having a larger diameter than the threaded shaft and an outer peripheral surface with projections, serrations and the like to improve gripping.

Alternatively or—preferably—in addition, means for engaging a rotation tool may be provided on the front end of the threaded rod that protrudes from the threaded bore.

According to another embodiment of the invention, the height of the pullout furniture component can be adjusted by providing in the top side of the base component facing the bottom side of the pullout furniture component a recessed region extending in the longitudinal direction of the sliding rail. A plate-shaped adjustment slider, which is flush with the top side of the base component in the initial position, may be arranged in the recessed region for displacement in the longitudinal direction of the sliding rail. The bottom side of the adjustment slider facing the bottom of the recessed region may be inclined relative to its flat surface in the longitudinal direction of the sliding rail. In the region of the sliding rail facing the bottom side of the adjustment slider, a raised inclined edge or surface may be provided which extends transversely to the slider adjustment direction and on which the inclined bottom side of the adjustment slider runs up during displacement relative to the base component.

Advantageously, a handle may be attached on the adjustment slider which projects from the region of the base component into the region below the bottom side of the pullout furniture component in the direction towards the rear drawer wall.

According to another advantageous embodiment of the invention, the locking receptacle may be formed by a receiving component formed as a toothed rack on the sliding rail, with a number of uniformly spaced locking teeth oriented perpendicular to the longitudinal direction of the sliding rail. The locking member which springily locks in the locking receptacle includes at least one locking projection formed as a complement to the spaces formed between the locking teeth of the locking receptacle.

Advantageously, the vertical locking surfaces of the locking teeth of the locking receptacle and of the locking projection of the locking member, which face each other in the insertion direction of the drawer, may be arranged with a complementary slope so that the at least one locking projection can springily run up on the locking receptacle in the insertion direction of the pullout furniture component and transition into the next space between the locking teeth of the locking receptacle that follows in the insertion direction.

To ensure that the pullout furniture component, for example a drawer, remains connected with the sliding rail when completely removed from the furniture body, the spaces in the locking receptacle formed between the locking teeth may be closed off at their upper vertical end by an upper boundary wall. The bottom side of the boundary wall then forms in each locking tooth space a stop face, which the locking projection of the locking member is able to cross only if it is retracted by a proportionate distance from the associated locking tooth space in the horizontal direction against the spring bias force that urges the locking projection into engagement with the locking receptacle.

Advantageously, an actuating lever which can be pivoted about an axis extending perpendicular to the bottom side of the pullout furniture component may be provided on the base component. The actuating lever may be connected with the locking member by a gear, so that the locking member is retracted from springy engagement with the locking receptacle when the actuating lever pivots away from its initial position.

To also compensate for a misalignment of drawers where the front drawer panel is more or less tilted away from the vertical direction, the invention advantageously provides for an additional adjusting fixture on the rearward end of the sliding rail, as viewed in the pullout direction, which may be functionally equivalent to the adjustment fitting according to the invention. A simpler embodiment of this adjustment fitting, as described for example in the prior unpublished utility model application 20 2006 003 035.2, can also be employed.

Two advantageous exemplary embodiments of the invention will now be described with reference to the drawings, which show in:

FIG. 1 illustrates a longitudinal cross-sectional view through a drawer with a telescopic guide arranged according to the invention in a marginal region of the bottom side of the bottom, with the telescopic guide allowing the drawer to be adjusted and fixed in position on the top side of its sliding rail in three coordinate directions by way of an adjustment fitting disposed in the front end region of the front panel according to a first exemplary embodiment;

Figures 1, 2, 3, 4:
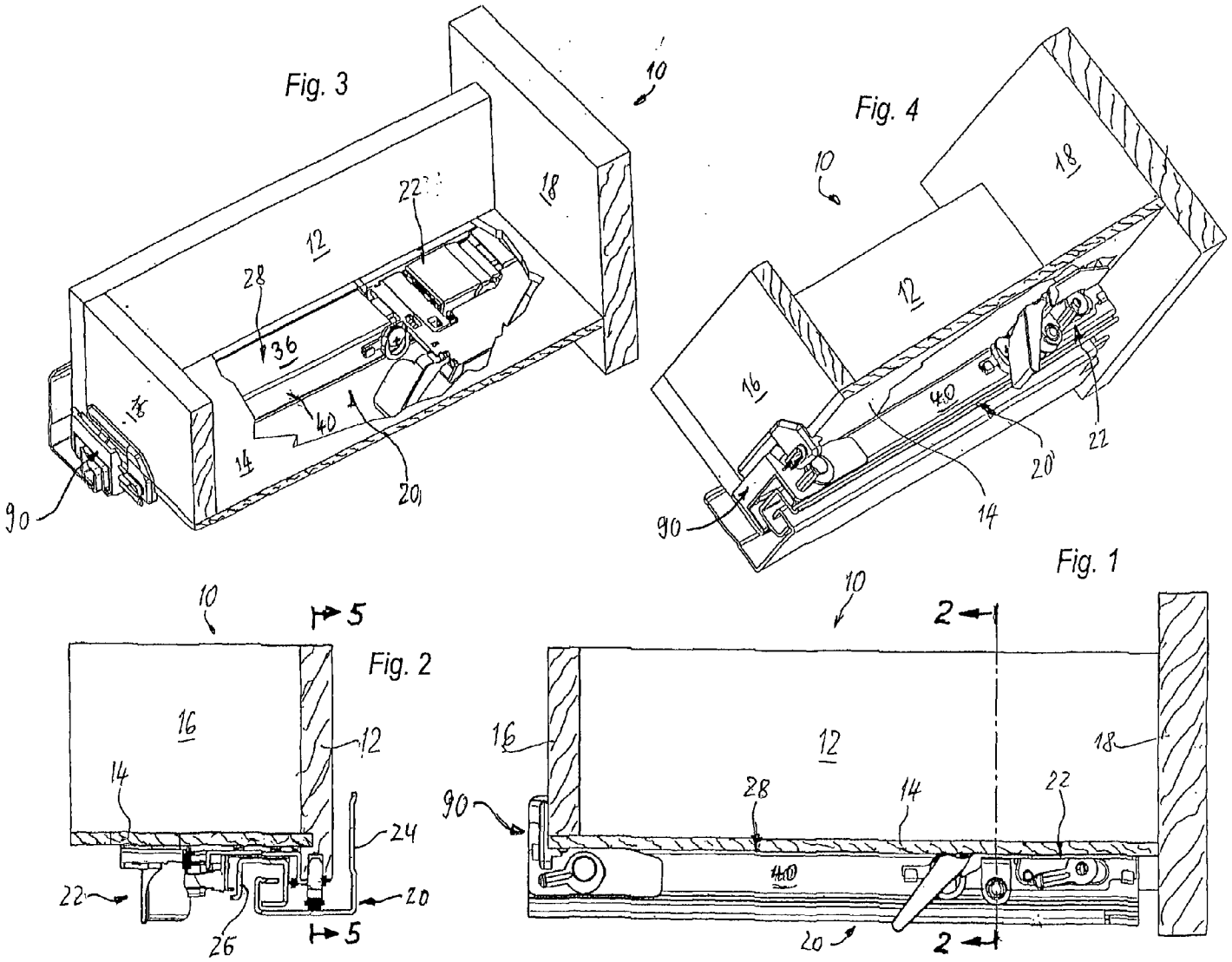
FIG. 2 illustrates a cross-sectional view in the direction of arrows 2-2 in FIG. 1.
FIGS. 3 and 4 illustrate isometric views of the part of the drawer illustrated in FIGS. 1 and 2 viewed at an angle from below and from above, respectively, wherein the bottom of the drawer is broken open in the region of the adjustment fitting.
Figures 5, 6A, 6B, 7, 8, 9, 10:
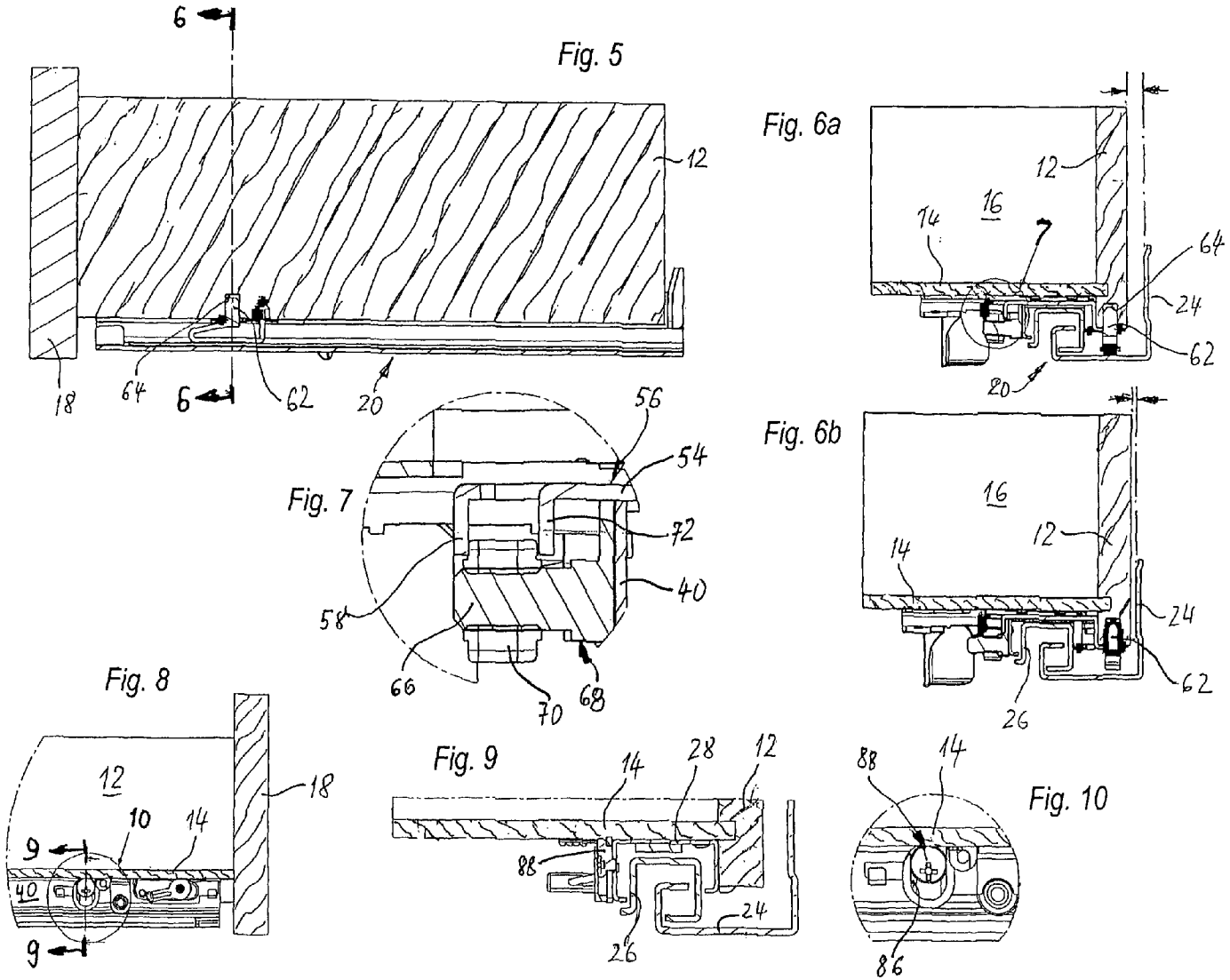
FIG. 5 illustrates a cross-sectional view in the direction of arrows 5-5 in FIG. 2.
Figure 12B:
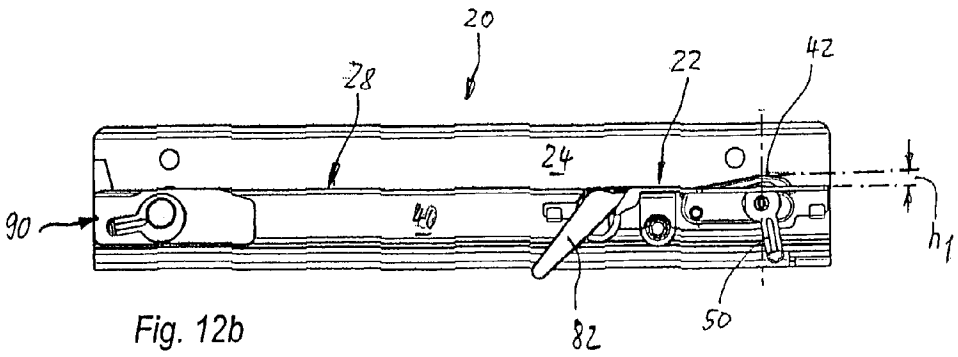
Figure 12A:
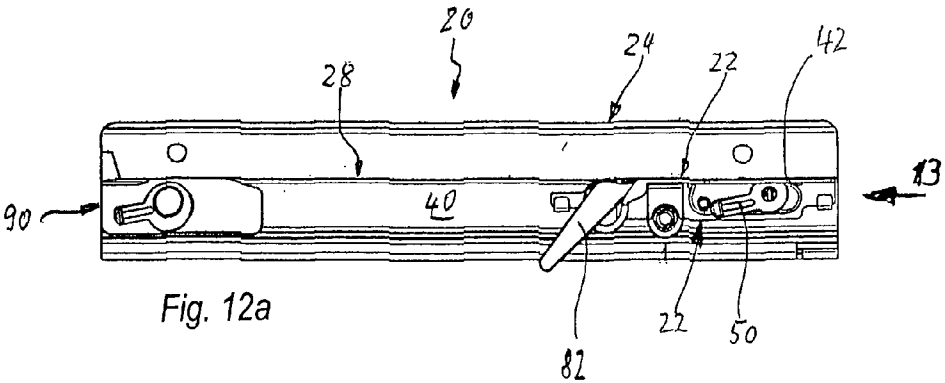
Figure 13:
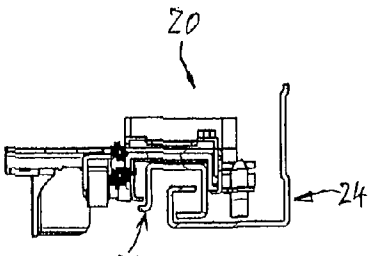
Figure 11:
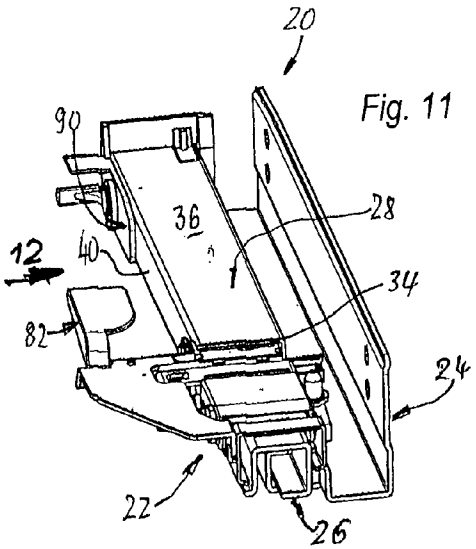

FIGS. 6*a* and 6*b* illustrate cross-sectional views in the direction of arrows 6-6 in FIG. 5, illustrating two different lateral adjustment positions of the drawer bottom on the sliding rail of the telescopic guide;

FIG. 7 illustrates, on an enlarged scale, a detailed view of FIG. 6*a* located inside the dash-dotted circle 7;

FIG. 8 illustrates a cross-sectional view of the partial front-panel section of the drawer corresponding to the cross-sectional view of FIG. 1;

FIG. 9 illustrates a cross-sectional view in the direction of arrows 9-9 in FIG. 8;

FIG. 10 illustrates a diagram of the region located inside the circle 10 of FIG. 8 on an enlarged scale;

FIG. 11 illustrates an isometric view of a telescopic guide provided according to the invention with an adjustment fitting disposed on the forward front-panel side end of its sliding rail;

FIGS. 12*a* and 12*b* illustrate a side view of the telescopic guide, viewed in the direction of arrow 12 in FIG. 11, wherein FIG. 12*a* illustrates an adjustment position, in which the bottom of a corresponding drawer is lowered on the topside of the sliding rail, while FIG. 12*b* illustrates an adjustment position which is raised in the vertical direction from the sliding rail;

FIG. 13 illustrates a view of the telescopic guide viewed in the direction of arrow 3 in FIG. 12*a;*

Figure 14B:
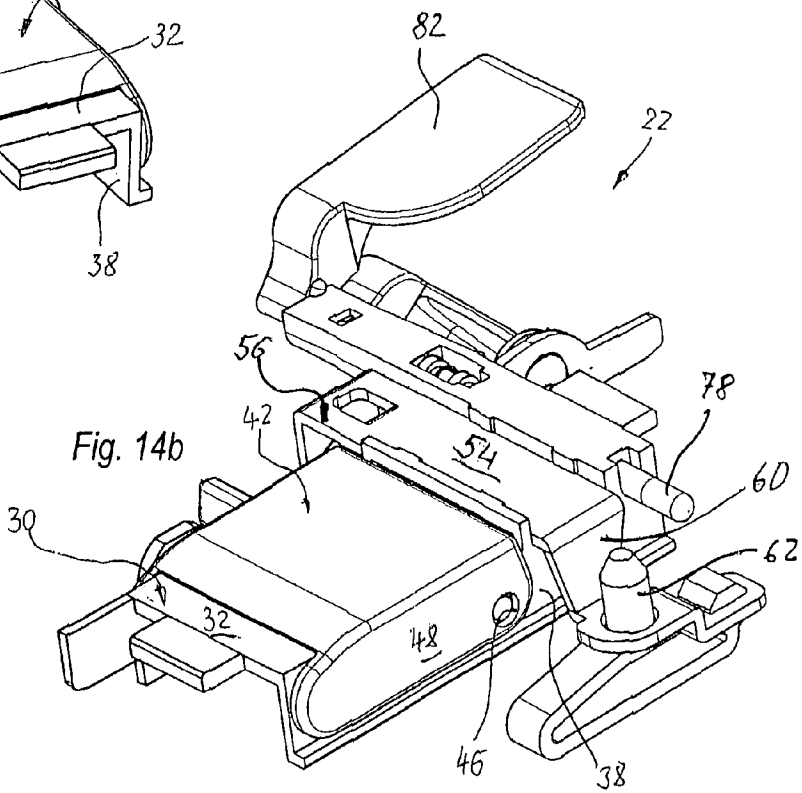
Figure 14A:
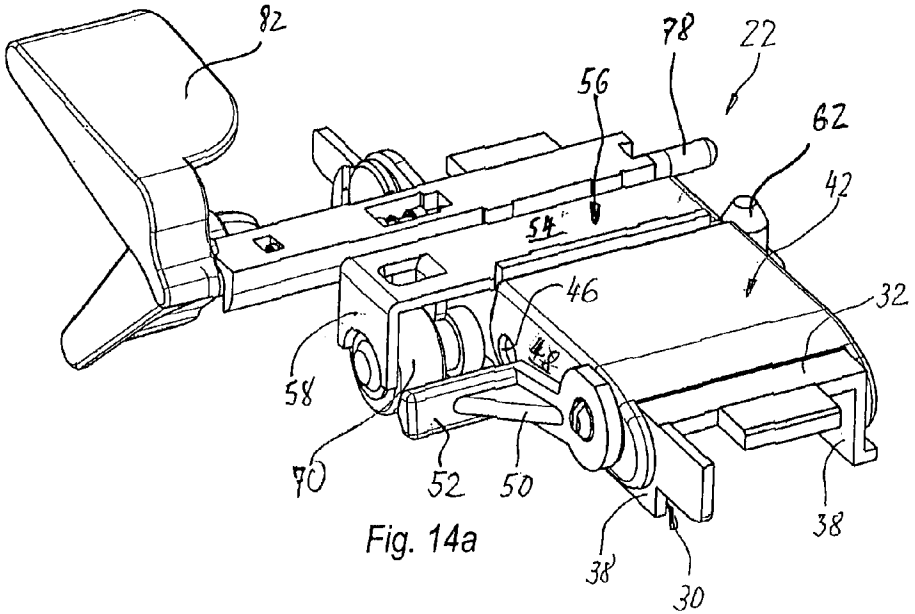
Figure 15:
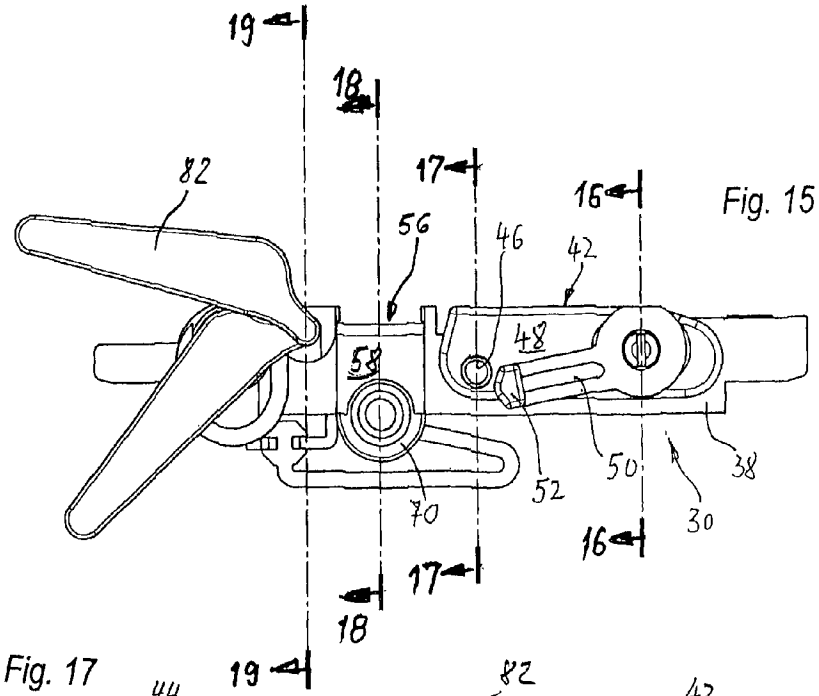

FIGS. 14*a* and 14*b* illustrate isometric views of the adjustment fitting in two different viewing directions;

FIG. 15 illustrates a side view of the adjustment fitting, viewed in the direction of arrow 15 in FIG. 14*a;*

Figure 16:
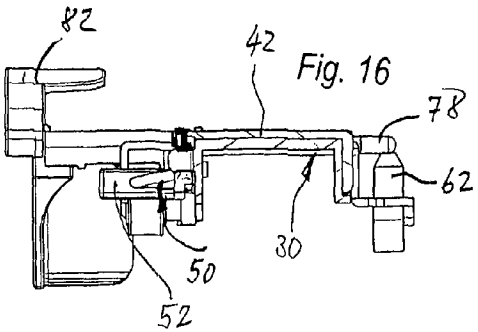

FIG. 16 illustrates a cross-sectional view through the adjustment fitting, viewed in the direction of arrows 16-16 in FIG. 14*a;*

Figure 17:
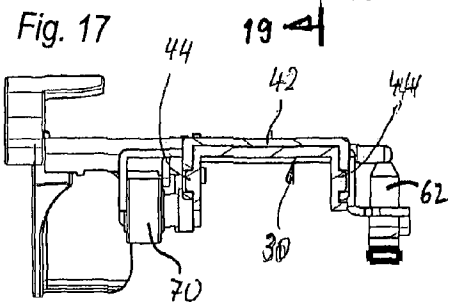
Figure 18:
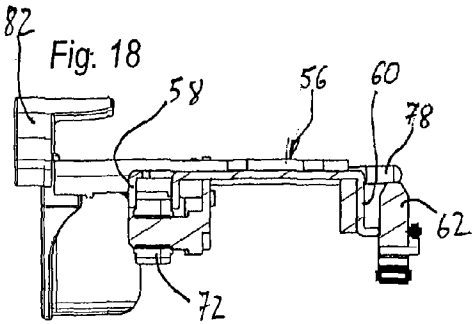
Figure 19:
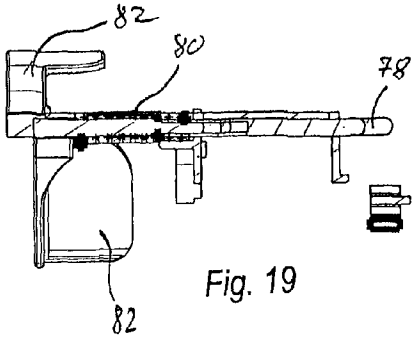
Figure 20:
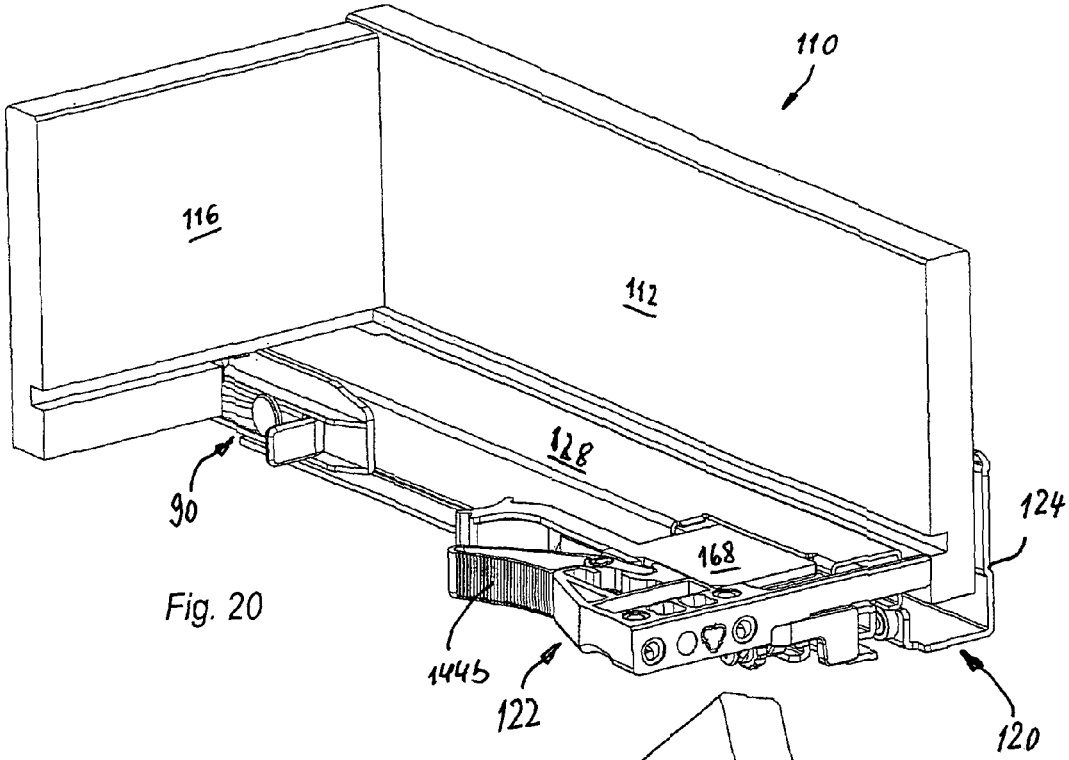
Figure 21:
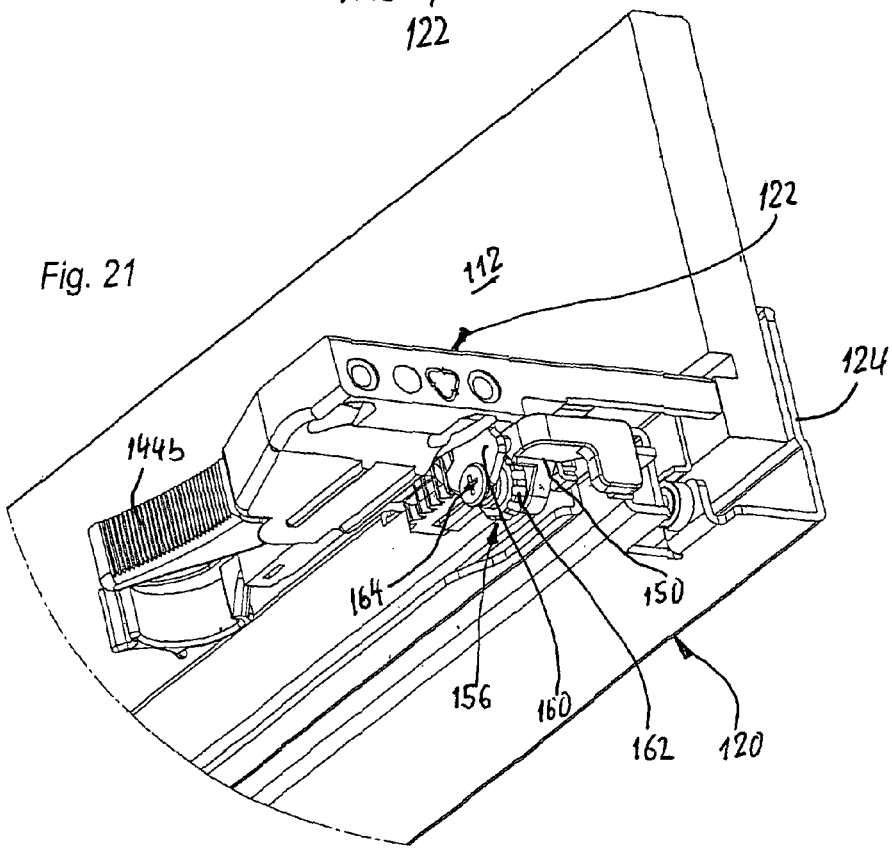
Figure 23:
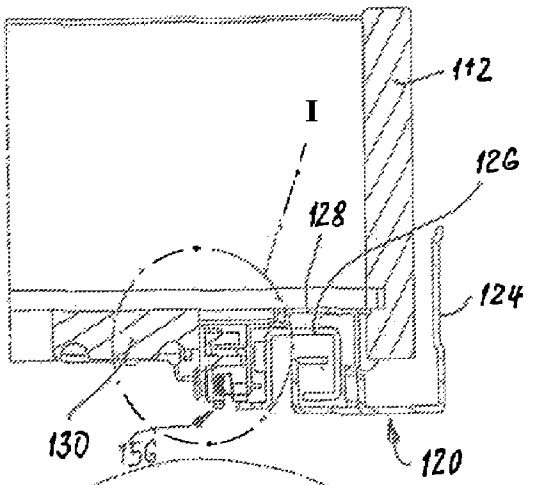
Figure 24:
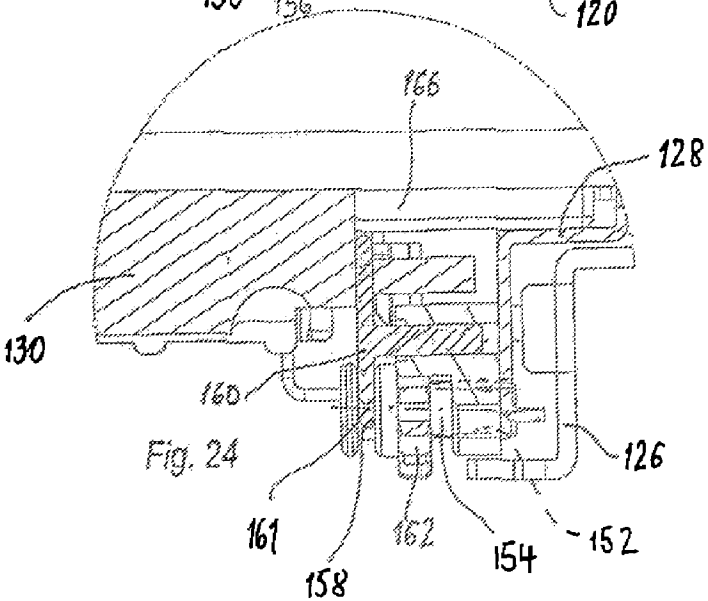
Figure 22:
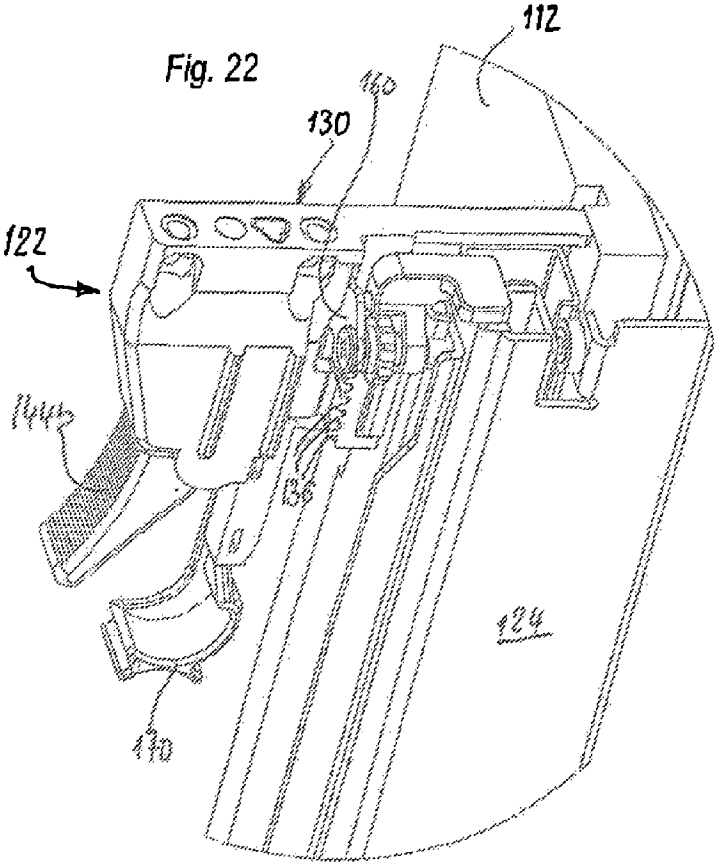
Figure 27:
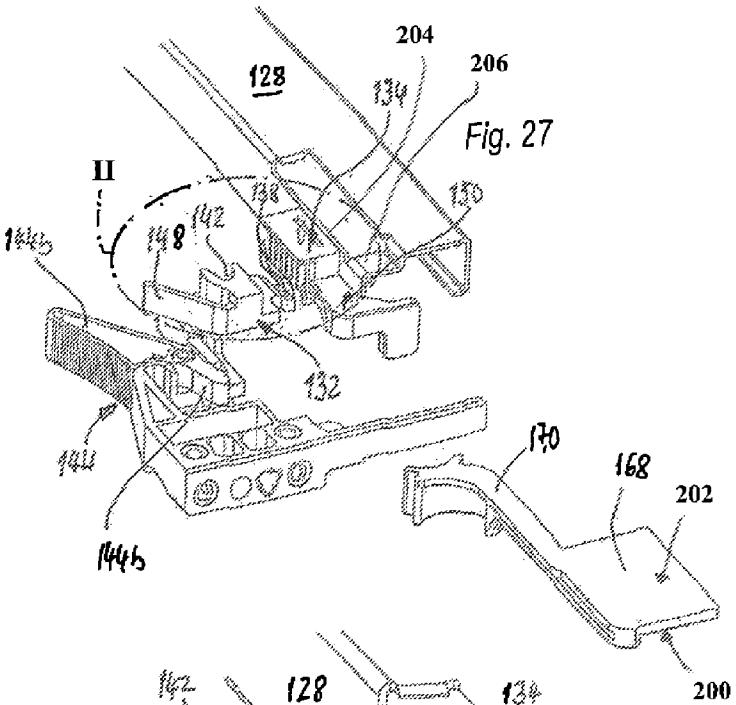
Figure 28:
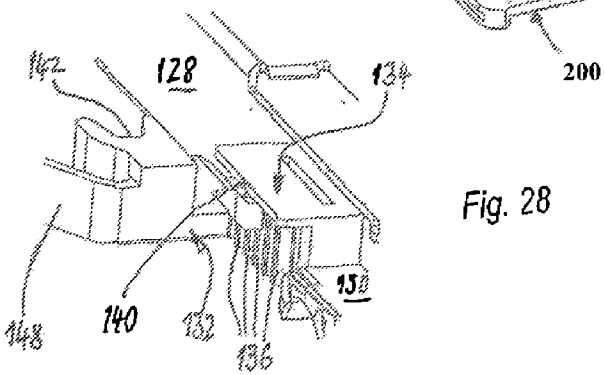
Figure 25:
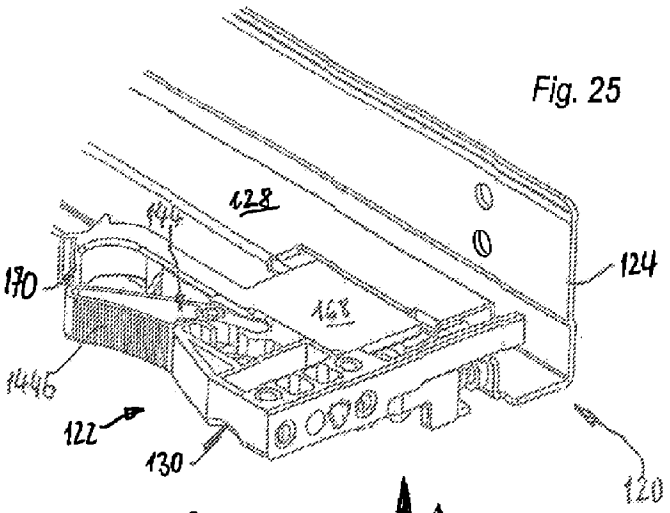
Figure 26:
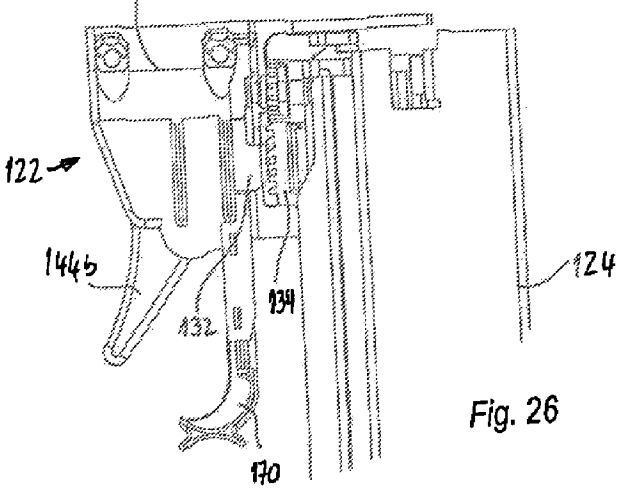

FIG. 17 illustrates a cross-sectional view through the adjustment fitting, viewed in the cross-sectional plane defined by the arrows 17-17;

FIG. 18 illustrates a cross-sectional view through the adjustment fitting, viewed in the direction of arrows 18-18;

FIG. 19 illustrates a cross-sectional view along the arrows 19-19 in FIG. 15;

FIG. 20 illustrates an isometric view of a partial region of the side wall and rear wall of a drawer without the bottom, with a telescopic guide arranged on the bottom side, allowing the drawer to be adjusted and fixed in position on the top side of its sliding rail in three coordinate directions by way of an adjustment fitting disposed in the front end region of the front panel according to a second exemplary embodiment;

FIG. 21 illustrates an enlarged isometric view of the front-panel side adjustment fitting disposed on the telescopic guide according to FIG. 21, showing its position in relation to the side wall of the drawer, viewed at an angle from below;

FIG. 22 illustrates an isometric view similar to that of FIG. 21, viewed at a different angle;

FIG. 23 illustrates a cross-section perpendicular and parallel to the front panel through the telescopic guide, the sidewall and the adjustment fitting according to FIGS. 20 to 22;

FIG. 24 illustrates, on an enlarged scale, a partial region of the cross-sectional view located inside the dash-dotted circle 24 in FIG. 23;

FIG. 25 illustrates an isometric view corresponding to that of FIG. 20, but without the side wall and rear wall of the drawer;

FIG. 26 illustrates a view on the bottom side of the adjustment fitting and the corresponding telescopic guide, viewed in the direction of arrow 26 in FIG. 25;

FIG. 27 illustrates an isometric view corresponding to that of FIG. 25, illustrating functionally cooperating components of the adjustment fitting and the front end of the sliding rail in an exploded view; and FIG. 28 illustrates features located inside the dash-dotted oval 28 in FIG. 27, wherein the functional components locking the adjustment fitting on the sliding rail are illustrated in the engaged locked position.

FIGS. 1 to 10 illustrate cross-sectional views of a drawer 10 or of partial regions of a drawer 10, which can be installed for movement in the—unillustrated—body of a piece of furniture with a pair of telescopic guides. FIGS. 11 to 13 show such telescopic guide separately, with an adjustment fitting 22, which is shown separately in FIGS. 14*a* to 19, arranged on the front ends facing the front panel, to allow adjustment and alignment of the drawer in the corresponding furniture body.

The drawer 10 has a conventional construction, i.e., it has two laterally spaced sidewalls 12 with grooves extending longitudinally in the lower section thereof, in which the lateral edges of the drawer bottom 14 are inserted. The space located above the bottom between the sidewalls is closed off at the rear end inside the furniture body by the rear wall 16. The front end of the drawer outside the furniture body is provided with a front panel 18 which overlaps the end faces of the sidewalls 12 and the bottom 14 on all sides.

The telescopic guide used in the illustrated exemplary embodiment is constructed as a so-called "fully-extendable drawer guide", wherein a guide rail 24, which is constructed as a metal rail profile and can be attached to the corresponding support wall of the furniture body, movably and guidingly supports a sliding rail 28 which can be installed in the lateral marginal region of the drawer on the bottom side of the bottom 14 by way of a likewise metal center rail profile 26 by way of (unillustrated) roller bearings. The adjustment fitting 22 has in cross-section a mounting element 30 formed as a U-profile rotated by 180° about its longitudinal axis, wherein the web face 32 is arranged in an opening 34 of the web face 36 of the sliding rail 28. The leg faces 38 which are bent downward from the web face 32 of the mounting element 30 at a right angle tightly encompass the leg faces 40 that are bent from the web face 36 of the sliding rail 28. The mounting element 30 is held on the sliding rail 28 in a suitable manner, for example by tabs protruding from the lateral web faces 38 and/or the leg face 32 and engaging in corresponding openings in the sliding rail 28.

In the front region, i.e., in the region outside the furniture body or on the front panels, a support element 42 is supported on the mounting element 30 with its top side facing the drawer bottom and can be pivoted upwardly about an axis extending transversely to the pullout direction. To this end, pins 44 (FIG. 17) which protrude from the leg faces 38 of the mounting element 30 engage in corresponding openings 46 disposed in leg faces 48 which are bent away from the upper contact surface of the support element 42 and encompass the sides of the mounting element.

A lever arm 50 is pivotally supported on the mounting element and hence—with the installed adjustment fitting 30—also on the sliding rail 28 in spaced-apart relationship relative to the front-panel end of the mounting element 30. In the support region, the lever arm 50 has an eccentric element 52 (FIG. 16) protruding toward the mounting element and arranged in an (unillustrated) slotted through-opening in the lateral leg faces 48 of the support element 42. By rotating the lever arm 50, which has a handle 52 on its free end, the eccentric element is rotated, whereby its outer peripheral surface supported in the slotted through-opening pivots up and down, depending on the eccentricity and the rotation angle of the lever arm through the support element 42. FIGS. 12*a* and 12*b* illustrate two different pivot positions of the lever arm 50. As can be seen, the support element 42 pivots upward when the lever arm 50 is rotated in the vertical direction by a value hi from the initial position illustrated in FIG. 12*a* to the position illustrated in FIG. 12*b*. Accordingly, a drawer supported on the sliding rail 28 is also raised by a distance hi when the lever arm 50 is rotated.

An elongated narrow web segment 54 of a bracket-shaped adjustment console 56 is supported for lateral displacement on the web face 32 behind the support element 42 in the pullout direction. Tabs or downwardly bent sections 58, 60 are integrally attached at the ends of the web segment 54, which in the displacement direction is longer than the width of the mounting element 30 measured across the outside of the leg faces 38, The bent section 60 facing the adjacent support wall of the furniture body receiving the drawer 10 springily supports an upwardly oriented dowel pin 62 for displacement in the downward direction. The upper chamfered free end of the dowel pin 62 engages in a receiving bore 64 disposed in the lower horizontal end face of the sidewall 12 of the drawer 10 (FIGS. 2, 5, 6*a* and 6*b*) and, upon engagement in the receiving bore 64, connects the drawers in their horizontal transverse adjustment directions as well as in their pullout direction form fittingly with the console 56, while still allowing the drawer to be raised, i.e., moved in the vertical direction.

The height adjustment of the drawer through rotation of the lever arm 50 is therefore not hindered by the engagement between the dowel pin 62 and the receiving bore 64. The bent segment provided on the opposing end of the web section 54 of the console 56 overlaps the outer front face of an adjusting nut 70 which threadingly engages with the threaded rod 66 of an adjusting bolt 68 that is non-rotatably secured on the adjacent leg face 40 of the sliding rail 28. An additional downwardly bent tab 72 stamped from the material of the console 56 and facing the opposing front face of the adjusting nut 70 ensures that the bracket-shaped console 56 is always moved on the threaded rod 66 in the transverse direction commensurate with the displacement of the adjusting nut 70. The adjusting bolt that is non-rotatably arranged on the sliding rail hence forms an adjustment device as a result of the horizontal entrainment connection between the adjusting nut 70 screwed onto the threaded section 66 and the tab or bent section 58 or the tab 72, thereby allowing lateral movement of the console 56 and thereby also the drawer 10 relative to the sliding rail 28. The functional cooperation and construction of the components of this adjustment device is illustrated, in particular, in the enlarged partial cross-section of FIG. 7.

To ensure that the drawer cannot be raised to a position where the dowel pin 62 is located above the receiving bore 64, so as to accidentally disengage from the sliding rail 20, an elongated safety bolt 78, which can also move horizontally and transversely to the pullout direction, is secured on the mounting element 30 next to the console 56. The safety bolt 78 is biased by a spring 80 (FIG. 19) toward the adjacent support wall to a position, where its free end engages in an (unillustrated) receiving opening which overlaps the bottom 14 in the downward direction and terminates in the bottom inner surface of the side wall 12. Means for retracting the safety bolt 78 against the spring bias to a retracted position away from the receiving opening are provided on the opposing end of the safety bolt 78 facing away from the support wall. These means are formed by a handle which is non-rotatably attached on an end of the safety bolt facing away from the support wall and allows the safety bolt 78 to be rotated in its support on the mounting element 30. The rotation or pivoting motion can be transformed by suitable means—for example, through (unillustrated) three-dimensional curve tracking—into a displacement component of the safety bolt to the retracted position out of the receiving opening. In the retracted position out of the receiving opening, a locking device is also provided which prevents the safety bolt from unintentionally returning to the position where it engages the receiving opening as a result of the spring bias.

To allow, in addition to the adjustment of the drawer 10 in the vertical height direction and horizontally in the transverse direction, also adjustment of the drawer on the sliding rail 20 in the pullout direction, a vertical slit-like or slotted opening 86 is provided, in addition to the support for the safety bolt 78 in the web face 38 of the mounting element 30 facing away from the support wall. An eccentric element 88, which is rotatably supported in the opposing leg face 40 of the sliding rail 28 and has a diameter commensurate with the width of the opening 86, is arranged in the opening 86. Suitably formed recesses or projections for attaching a rotation tool can be provided in the front face of the eccentric element 88 that is exposed in the slit-like opening 86 and faces away from the support wall. FIG. 10 shows a cross-recess impressed in the front face of the eccentric element 88, in which a Phillips head screwdriver can be inserted for rotating the eccentric element 88 and consequently displacing the mounting element 30—depending on its rotation position—on the sliding rail 28.

To prevent the safety bolt 78 engaging in the corresponding receiving opening in the drawer side wall from hindering the adjustment motion, the receiving opening must have in the pullout direction a length commensurate with the desired adjustment travel in the pullout direction.

A second exemplary embodiment of an adjustment fitting will now be described with reference to FIGS. 20 to 28. The adjustment fitting, designated overall with the reference symbol 122, can be attached on the front end of a telescopic guide 120 to allow adjustment and alignment of a drawer 110 in a corresponding cabinet body. FIG. 20 illustrates only the sidewall 112 and the rear wall 116 of the drawer 110, with the bottom and the front face of the drawer not being shown so as not to obscure the adjustment fitting 122.

The adjustment fitting has a base component 130 which can be attached on the front panel near the drawer bottom and/or on the bottom of the drawer, i.e., in particular, adjacent to the inner face of the sidewall 112 extending beyond the bottom side of the bottom. The base component 130 springily urges a locking member 132, which is oriented parallel to the drawer bottom and transversely to the pullout direction of the sliding rail 128 of the telescopic guide 120, into a locking receptacle 134 disposed on the sliding rail 128.

This locking receptacle is formed by a receiving component formed as a toothed rack disposed on the sliding rail 128 with a plurality of uniformly distributed vertical locking teeth 136 oriented perpendicular to the longitudinal direction of the siding rail. The locking member 132 has tooth-like locking projections 138 which are formed complementary to the spaces formed between the locking teeth 136, so that the sliding rail 128 and the drawer 110 are maintained in form-fitting engagement when the locking teeth springily engage in the locking projections 138 when the drawer is pulled out. The perpendicular locking surfaces of the locking teeth 136 of the locking receptacle 134 and the locking projections 138 of the locking member 132, which face one another in the engagement position, are complementarily inclined. The locking projections springily then slide along one another when the locking member 132 moves relative to the locking receptacle 134 in the insertion direction of the drawer, transitioning into the adjoining space between the locking teeth of the locking receptacle in the insertion direction.

The spaces between the locking teeth of the locking receptacle are closed off at the top end by a vertical end wall 140, which extends slightly beyond the free ends of the locking teeth across the projections 138 of the locking member 132. In this way, the drawer can be raised from the sliding rail 128 only if the locking member 132 is retracted out of locking engagement with the locking receptacle 132 in the horizontal direction to such a degree that the locking projections 138 are located in front of the free boundary edge of the end wall 140.

In the illustrated example, where the locking member 132 is fabricated as an injection molded plastic part, a receptacle 142 is formed therein for the free end of a lever arm 144*a* of a two-armed lever 144, which is supported for rotation about a vertical axis on the base component 130, with the second lever arm forming an operating handle 144*b* for retracting the locking projections 138 from locking engagement with the locking receptacle 134. Also molded on the locking member 132 is an elongated tab 148 which is urged by spring bias against the backside of the lever arm 144*b* facing away from the sliding rail. The tab 148 biases the two-arm lever 144 so that the locking projections 138 of the locking member 132 springily lock in the spaces between the locking teeth 136 of the locking receptacle 134.

The locking receptacle 134, which in the present example is also made as an injection molded plastic part, also includes a threaded bore 152 disposed in a projection 150 protruding relative to the front panel of the drawer and extending parallel to the drawer bottom and perpendicular to the longitudinal direction of the sliding rail. A threaded rod or shaft 154 of an adjustment member 156 engages with the threaded bore 152. The free end of the threaded shaft 154 protruding from the threaded bore can rotate freely, but is fixedly coupled to the base component 130 in the longitudinal direction of the threaded rod. This coupling action is attained by providing in the free end of the threaded rod 154 a circumferential groove 158, in which the lateral boundary walls of a slit 161, which is open at the bottom, engage with a locking plate 160 which protrudes from the base component 130 and is carried along in the longitudinal direction of the threaded rod by the locking base component. A handle 162 in form of a ring flange having a diameter greater than that of the threaded rod 154 is disposed in the region of the threaded rod that protrudes from the threaded bore, wherein the outer peripheral surface of the ring flange includes protrusions, serrations and the like to improve gripping.

In addition, in special cases a cross-recess 164 is provided in the front face of the end of the threaded rod 154 protruding from the threaded bore, in which the tip of a Philips screwdriver can be inserted. The threaded rod can optionally also be turned by manually rotating the threaded rod 154 with the handle 162 or by turning a Phillips screwdriver which is inserted with its tip into the cross-recess 164. Depending on the direction of rotation in the threaded bore, the threaded rod 154 is then screwed in one direction or the other, thereby displacing the locking plate 160 in the transverse direction of the drawer and hence moving the drawer itself with the base component 130 relative to the sliding rail 128 in the transverse direction.

A recessed region 166 extending in the longitudinal direction of the sliding rail is disposed on the top side of the base component 130. A plate-shaped adjustment slider 168, which in its initial position is flush with the topside of the base component, is arranged in the recessed region 166 and moveable in the longitudinal direction of the sliding rail. The slider 168 extends on the side of the sliding rail across a section of the sliding rail that is depressed relative to the upper leg face of the sliding rail facing the bottom of the drawer by the depth of the region 166. The bottom side 200 of the adjustment slider facing the bottom of the recessed region 166 is inclined in the longitudinal direction of the sliding rail relative to the flat top side. An inclined edge or surface 204 or 206 is provided in the region of the sliding rail 128 facing the bottom side 200 of the adjustment slider, which is oriented transversely to the adjustment direction of the slider 168. The inclined bottom side 200 of the adjustment slider 168 slides on the inclined edge or surface when moving relative to the base component. The adjustment slider 168 is therefore raised during displacement towards the rear wall 116 of the drawer, whereby the top side 202 of the adjustment slider 168 in contact with the drawer bottom raises the entire drawer 110 relative to the sliding rail. A handle 170 with an angled handle end, which protrudes from the region of the base component 130 into the region underneath the drawer bottom in the direction of the drawer rear wall, is attached on the adjustment slider 160 for adjusting the height of the drawer relative to the sliding rail.

It is evident that for securely, but adjustably, supporting the drawer 10, 110 on the sliding rail 28, 128 of the corresponding telescopic guide 20, 120, the rearward end region must also be supported, in addition to the support provided by the adjustment fitting 22, 122 disposed at the front end at the front panel. In the aforedescribed exemplary embodiments, a second adjustment fitting 90 is provided which connects the sliding rail 28, 128 with the rear drawer wall 16, 116, enabling active height adjustment of the drawer 10, 110 on the sliding rail. In addition, the adjustment fitting 22, 122 also allows adjustment of the drawers 10, 110 in the pullout direction as well as perpendicular thereto.

The invention claimed is:

1. A flush-mounted guiding arrangement for adjustable support of a furniture component within a furniture body, the guiding arrangement comprising:

a pair of telescopic guides configured to support a body of a piece of furniture for extension and retraction, wherein each telescopic guide has a guide rail attachable to a support wall of the furniture body;

a sliding rail guided for longitudinal displacement on the guide rail and positionable on a bottom side of the furniture component, wherein the sliding rail encompasses the guide rail at least partially from above and is shaped as a rail profile that is open at a bottom side;

an adjustment fitting provided at least in a front end region of the sliding rail, wherein the adjustment fitting is configured to operate on the bottom side of the furniture component to be supported and has an adjustment mechanism for adjusting a position of the sliding rail relative to the furniture component in a direction of at least one axis of a coordinate system formed of three mutually essentially perpendicular coordinate axes; and a base component of the adjustment fitting is adapted for contacting the bottom side of the furniture component, wherein the base component has a locking member springily engaging a locking receptacle disposed on the sliding rail when the sliding rail of the telescopic guide on the furniture component is in a predetermined mounting position, the adjustment mechanism comprising an adjustment member with a threaded rod having a longitudinal center axis oriented parallel to the bottom side of the furniture component and oriented substantially perpendicular to a pullout direction of the sliding rail, wherein the threaded rod of the adjustment member threadingly engages the sliding rail or the base component and is rotatably supported in a longitudinal direction of the threaded rod while being prevented from being displaced on the base component or the sliding rail, wherein the threaded rod of the adjustment member engages a complementary threaded bore disposed in the sliding rail, and further wherein a free end of the threaded rod protrudes from the threaded bore, is rotatably coupled to the base component and is displaceable in the longitudinal direction of the threaded rod.

2. The flush-mounted guiding arrangement according to claim 1 further comprising:

a circumferential groove disposed in a region of the free end of the threaded rod of the adjustment member and engaging a projection disposed on the base component.

3. The flush-mounted guiding arrangement according to claim 2, wherein the projection is formed by a locking plate on the base component and has a slotted opening open on a bottom side of the locking plate, wherein the slotted opening has an unobstructed width approximately equal to a diameter measured above a groove bottom of the circumferential groove in the threaded rod, wherein the slotted opening has a thickness approximately equal to the unobstructed width of the groove at least in a region inside the circumferential groove corresponding to a defined entrainment position.

4. The flush-mounted guiding arrangement according to claim 3, further comprising:

a handle in the region of the threaded rod, wherein the handle protrudes from the threaded bore.

5. The flush-mounted guiding arrangement according to claim 3, further comprising:

an adjusting fixture provided on a rearward end of the sliding rail.

6. The flush-mounted guiding arrangement according to claim 2, further comprising:

a handle in the region of the threaded rod, wherein the handle protrudes from the threaded bore.

7. The flush-mounted guiding arrangement according to claim 2, further comprising:

an adjusting fixture provided on a rearward end of the sliding rail.

8. The flush-mounted guiding arrangement according to claim 1, further comprising:

a handle protruding from the threaded bore.

9. The flush-mounted guiding arrangement according to claim 8, wherein the handle is formed by a circumferential ring flange having a diameter larger than a diameter of the threaded rod and an outer peripheral surface with projections or serrations.

10. The flush-mounted guiding arrangement according to claim 9, further comprising:

means for engaging a rotation tool provided on a front end of the threaded rod and protruding from the threaded bore.

11. The flush-mounted guiding arrangement according to claim 8, further comprising:

means for engaging a rotation tool provided on a front end of the threaded rod and protrudes from the threaded bore.

12. The flush-mounted guiding arrangement according to claim 1, further comprising:

a recessed region extending in a longitudinal direction of the sliding rail, wherein the recessed region is provided in the top side of the base component facing the bottom side of the furniture component, and an adjustment slider flush with the top side of the base component in an initial position, wherein the adjustment slider is arranged in the recessed region for displacement in the longitudinal direction of the sliding rail, wherein a bottom side of the adjustment slider faces a bottom of the recessed region being inclined relative to a flat surface of the adjustment slider in the longitudinal direction of the sliding rail, wherein a raised inclined edge or surface provided in a region of the sliding rail faces the bottom side of the adjustment slider, wherein the raised inclined edge or surface extends transversely to a slider adjusting direction, wherein the inclined bottom side of the adjustment slider runs up the raised inclined edge or surface during displacement relative to the base component.

13. The flush-mounted guiding arrangement according to claim 12, further comprising:

a handle attached to the adjusting slider and projecting from a region of the base component into a region below the bottom side of the furniture component in a direction towards a rear drawer wall.

14. The flush-mounted guiding arrangement according to claim 1, wherein the locking receptacle is formed by a receiving component formed on the sliding rail as a toothed rack with a number of uniformly spaced locking teeth oriented perpendicular to the longitudinal direction of the sliding rail, wherein the locking member springily locks in the locking receptacle and comprises at least one locking projection formed as a complement to spaces formed between the locking teeth of the locking receptacle.

15. The flush-mounted guiding arrangement according to claim 14 further comprising:

first vertical locking surfaces provided on the locking teeth of the locking receptacle; and second vertical locking surfaces provided on the locking projection of the locking member, wherein the vertical locking surfaces of the locking receptacle and the vertical locking surfaces of the locking member face each other in the insertion direction of the furniture component and are arranged with a complementary slope so that the at least one locking projection springily runs up on the locking receptacle in the insertion direction of the furniture component and transitions into an adjoining space between the locking teeth of the locking receptacle that follows in the insertion direction.

16. The flush-mounted guiding arrangement according to claim 15, wherein the spaces in the locking receptacle formed between the locking teeth are closed off at their vertical top end by an upper boundary wall.

17. The flush-mounted guiding arrangement according to claim 14, wherein the spaces in the locking receptacle formed between the locking teeth are closed off at their vertical top end by an upper boundary wall.

18. The flush-mounted guiding arrangement according to claim 14, further comprising:

an actuating lever on the base component, wherein the actuating lever is pivotable about an axis extending perpendicular to the bottom side of the furniture component, wherein the actuating lever is connected to the locking member) so that the locking member is retracted from springy engagement with the locking receptacle when the actuating lever is pivoted away from an initial position.

19. The flush-mounted guiding arrangement according to claim 1, further comprising:

an adjusting fixture provided on a rearward end of the sliding rail.

20. The flush-mounted guiding arrangement according to claim 1, wherein the furniture component is a drawer.

* * * * *

UNITED STATES PATENT AND TRADEMARK OFFICE

CERTIFICATE OF CORRECTION

PATENT NO. : 8,336,973 B2
APPLICATION NO. : 12/297019
DATED : December 25, 2012
INVENTOR(S) : Berger It is certified that error appears in the above-identified patent and that said Letters Patent is hereby corrected as shown below:

In the Specification

Column 8, line 11, “hi” -- should read -- $h_1$ --.

Column 8, line 11, “hi” -- should read -- $h_1$ --.

Column 8, line 22, “38,” -- should read -- 38. --.

Signed and Sealed this
Twelfth Day of August, 2014

Michelle K. Lee

Michelle K. Lee
*Deputy Director of the United States Patent and Trademark Office*